US005810616A

United States Patent [19]

Ivey

[11] Patent Number: 5,810,616

[45] Date of Patent: Sep. 22, 1998

[54] INSULATION DISPLACEMENT CONNECTORS

[75] Inventor: David Ernest Ivey, Whitchurch, United Kingdom

[73] Assignee: Molex Incorporated, Lisle, Ill.

[21] Appl. No.: 648,101

[22] PCT Filed: Sep. 18, 1995

[86] PCT No.: PCT/GB95/02206

§ 371 Date: Nov. 25, 1996

§ 102(e) Date: Nov. 25, 1996

[87] PCT Pub. No.: WO96/09663

PCT Pub. Date: Mar. 28, 1996

[30] Foreign Application Priority Data

Sep. 19, 1994 [GB] United Kingdom ..... 9418847

[51] Int. Cl.[6] ..... H01R 4/24

[52] U.S. Cl. ..... 439/395; 439/404

[58] Field of Search ..... 439/395–408, 439/417–419, 707

[56] References Cited

U.S. PATENT DOCUMENTS

| | | | |
|---|---|---|---|
| 3,683,319 | 8/1972 | Vigeant et al. | 339/97 R |
| 3,854,114 | 12/1974 | Kloth et al. | 339/97 R |
| 3,895,852 | 7/1975 | Wasserlein, Jr. | 339/99 R |
| 3,985,416 | 10/1976 | Dola et al. | 339/97.99 |
| 4,410,229 | 10/1983 | Stephenson | 439/405 |
| 4,909,754 | 3/1990 | Paradis | 439/405 |
| 5,044,979 | 9/1991 | Siemon et al. | 439/404 |
| 5,269,700 | 12/1993 | Mitra | 439/395 |
| 5,522,733 | 6/1996 | White et al. | 439/395 |

FOREIGN PATENT DOCUMENTS

| | | | |
|---|---|---|---|
| 0383135A1 | 8/1990 | European Pat. Off. | H01R 4/24 |
| 0511098A1 | 10/1992 | European Pat. Off. | H01R 4/24 |
| 0613211A1 | 8/1994 | European Pat. Off. | H01R 4/24 |
| 1361127 | 7/1974 | United Kingdom | H01R 9/08 |
| 1434003 | 4/1976 | United Kingdom | H01R 7/04 |
| 2112217 | 7/1983 | United Kingdom | H01R 4/24 |
| 2271892 | 4/1994 | United Kingdom | H01R 4/24 |
| WO 92/22941 | 12/1992 | WIPO | H01R 4/24 |

*Primary Examiner*—Hien Vu
*Attorney, Agent, or Firm*—A. A. Tirva

[57] ABSTRACT

A folded "V" shaped contact insulation displacement connector is modified to enable use with wires having hard insulation. The slot 20 separating the two contact blades 14, 16 has a constant width along its length. There is no enlarged aperture at the base of the slot so that the contact is most rigid at the bottom of the slot. The housing is modified to provide a small lateral and torsional clearance between the contacts and the cavities 42 and the housing 44 in which they are retained.

4 Claims, 1 Drawing Sheet

FIG. 1(a)
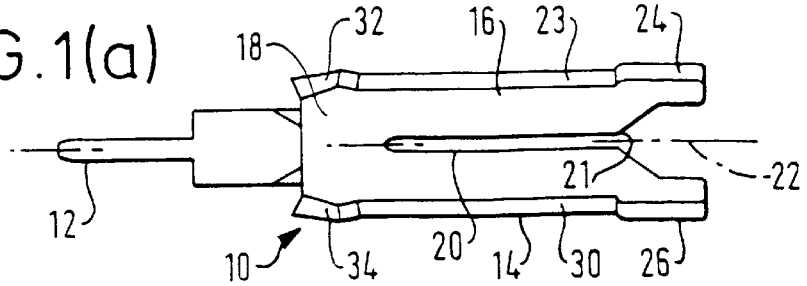
FIG. 1(b)
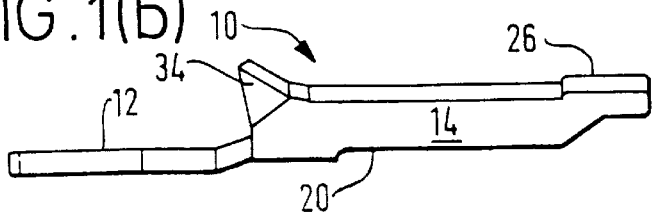
FIG. 1(c)
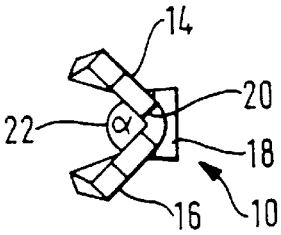
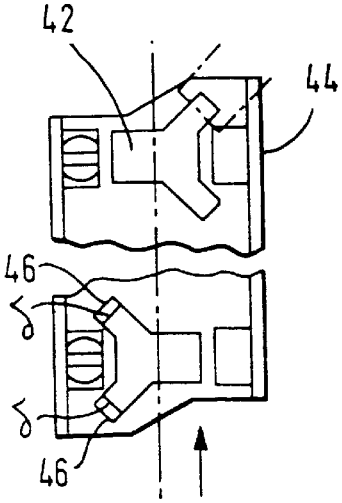
FIG. 2(a)
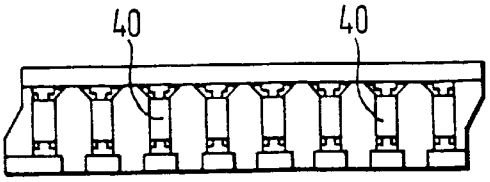
FIG. 2(b)
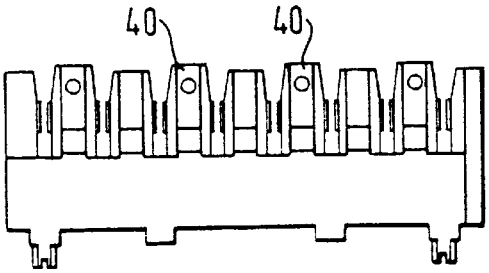
FIG. 2(c)
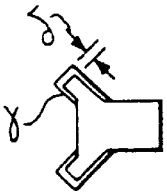
FIG. 3

INSULATION DISPLACEMENT CONNECTORS

BACKGROUND OF THE INVENTION

This invention relates to insulation displacement connectors for voice and data communication. It is particularly concerned with insulation displacement connectors of the type using a folded contact in which an insulation penetrating slot is defined between two planar blades which are arranged substantially at right angles to each other.

Our earlier application PCT/GB92/00998 published as WO 92/22941 the contents of which are incorporated by reference, describes a contact arrangement of this general type. A similar contact is disclosed in U.S. Pat. No. 5,044,979 (assigned to the Siemon Co.). The contacts disclosed in these specifications are supported both. laterally and torsionally by the plastic housing of the connector. The lateral support prevents spreading of the contact blades of wire insertion and the torsional support prevents twisting. Because of this support, the contact is more rigid at the point of wire entry than at the point of final termination. A version of this type of contact is disclosed in GB-A-1361127 (ISE). In this disclosure two separate blades are arranged at right angles to one another and held in a blade holder. The blades are intended to be removed and re-arranged to prevent a fresh blade to the wires and are not designed to be mounted in a plastics housing so that there is no mechanism to support the blade except at its base. This is in contrast to conventional IDC contacts where both blades lie within a common plane such as disclosed, for example, in U.S. Pat. No. 3,611,264 (Ellis).

Contacts described in PCT/GB92/00998 and U.S. Pat. No. 5,044,979 operate by emulating a split cylinder. On wire insertion, the blades bow outwards as the blades are held firmly in position at their open ends. As a result, the contacts can hold two or more wires, overcoming a failing of the planar type contact described in Ellis and other specifications.

We have found that contacts of the type described in PCT/GB92/00998 and U.S. Pat. No. 5,044,979 do not operate satisfactorily with wires having hard insulation. The mechanical arrangement of the contact has difficulty in correctly contacting the conductors of such wires.

Due to the mechanical constraints imposed on the prior art contacts by the connector body, there is virtually no movement of the insulation displacement slot defined between the two planar blades at the wire entry point when a wire is inserted. Only when the wire moves below this entry point does any significant contact deflection occur.

If the wire has a particularly hard insulation, such that it is insufficiently or improperly penetrated at the insertion point, the connection between the wire and the contact worsens as the contact deflects with further downward movement of the wire into the slot. This causes intermittent or permanent circuit discontinuity.

The invention in its various aspects aims to overcome the aforementioned problem with the prior art and to provide an insulation displacement contact and connector which is reliable when used with wires having a hard insulation.

SUMMARY OF THE INVENTION

The invention, in essence, resides in an insulation displacement connector in which the contacts are supported in the housing against torsional movement but in which a degree of lateral movement is permitted.

More specifically there is provided a "V" shaped insulation displacement contact for receiving and establishing electrical contact with insulated wires, comprising a first contact portion, a medial portion and a second contact portion, the second contact portion comprising a pair of spaced apart contact blades defining a slot therebetween, the contact blades being folded about an axis of the contact, characterised in that the width of the slot along the length of the slot is substantially constant whereby the stiffness of the contact blades is greatest at the base of the slot, and in that the slot is sufficiently long to receive two insulated wires.

A contact embodying the invention has the advantage that insulation displaced from the wire at the top of the slot cannot creep back between the wire and the walls of the slot when the wire is at rest at the point of final termination. The contact is suitable for use with wires having hard insulation.

The invention also provides an insulation displacement connector comprising a housing, a plurality of cavities, and a plurality of "V"-shaped contacts for receiving and establishing electrical contact with insulated wires, each contact having a first contact portion, a medial portion and a second contact portion comprising a pair of planar contacts folded about an axis of the contact, each second contact portion being received in a respective one of the plurality of cavities in the housing, each cavity being generally "VI" shaped and corresponding to the second portion of the contact, characterised in that the relative dimensions of the contacts and the respective cavities permits an amount of lateral movement of the contact blades within their respective cavities less than the width of the longitudinal slot defined between the contact blades.

BRIEF DESCRIPTION OF THE DRAWINGS

An embodiment of the invention will now be described, by way of example, and with reference to the accompanying drawings in which:

FIG. 1(A) is a plane of a contact embodying the invention;

FIG. 1(B) is a side view of the contact of FIG. 1(A);

FIG. 1(C) is a top view of the contact of FIG. 1(A);

FIG. 2(A) is a partial underside view of the housing showing the contact receiving cavities;

FIG. 2(B) is a side view of the housing;

FIG. 2(C) is a top view of the housing; and

FIG. 3 shows, schematically, a contact received in a housing cavity.

DESCRIPTION OF THE PREFERRED EMBODIMENT

The general shape of the "V" shaped insulation displacement contact and housing shown in the figures is well known and described in detail, for example, in PCT/GB92/00998 referred to earlier. Contacts made according to the disclosure of this patent are available from Mod-Tap W Corporation of Harvard, Mass., U.S.A. and from Mod-Tap Limited of Southampton, England. The contact 10 of FIG. 1 is intended for attachment to a printed circuit board (PCB) and has at its one end a first contact portion in the form of a tail 12. The other end of the contact has a second contact portion comprising the insulation displacement portion and having two planar blades or tines 14, 16 extending from a central or medial portion 18 and spaced apart to define a slot 20. As can best be seen from FIG. 1(C) the two planar blades 14,16 are folded about the central longitudinal axis 22 of the contact, the axis bisecting slot 20. The slot begins at the mouth 21 of the second contact portion and has a width that is substantially constant along its length. It is sufficiently long to receive at least two insulated wires. The internal angle α (FIG. 1(C)) between the two planar contacts is approximately 90°. In practice, other angles are possible. Thus, the insulation displacement contact is of the general type known as a folded "V" contact. The free ends of the planar blades each carry a terminal outer tab portion 24, 26 which are received in the contact teeth 40 of the connector body (FIG. 2). The tabs 24, 26 extend laterally beyond the edges 28, 30 of the planar blades. The medial portion 18 of the contact carries barbs 32, 34 which, on insertion of the contact into the connector, embed themselves in the connector wall to secure the contact in position. Although shown as a PCB contact the contact may be designed with a second insulation displacement contact replacing the tail 12. This may be a planar contact as illustrated in PCT/GB92/00998 or any other form such as a "V" contact.

The contact differs from prior art folded "V"-type contacts in that the slot 20 terminates at the middle of the contact 18 without expanding into an enlarged aperture. As can be seen from FIG. 1 the width of the slot is constant along its length as far as the base of the slot. The slot is defined as commencing at the mouth 21 where the sloped ends of the blades meet. In contrast to the prior art, the contact of FIG. 1 is at its most rigid at the bottom of the slot and at its least rigid at the point of wire entry. This ensures that insulation displaced from the wire at the top of the slot cannot creep back between the wire and the walls of the slot when the wire is at rest at the point of final termination.

Referring now to FIG. 2, the prior art housings for "V" shaped connectors support the "V" shaped part of the contact, that is the blades 14, 16 torsionally, and the tabs 24, 26, both laterally and torsionally. This support is provided by making each of the contacts fit snugly into the respective cavities provided for them in the connector body, allowing absolutely minimum cavity dimensions whilst still allowing assembly of the contact into the body. In FIG. 2 the individual cavities for the contacts are shown at 42 in the connector body 44. The cavities 42 of the housing in the embodiment of the invention are designed to allow lateral clearance between the blades of the contact and the walls of the contact receiving cavity 42 in the connector housing 44. In FIG. 2A this lateral clearance is shown as δ indicating the distance between the edge of the contact in the cavity and the end wall 46 of the cavity.

In a typical contact the clearance is approximately 0.2 mm for each contact blade for a contact having an insulation stripping slot 20 of width 0.3 mm and designed to accept a maximum wire diameter of 0.6 mm. Thus, even if neither the wire nor the contact yielded during wire insertion, each contact arm would displace by approximately 0.11 mm, thus clearance between the lateral edges of the contact and the contact receiving cavity in the connector is always ensured. The contact arm displacement is calculated as the square root of the square of half the dimensional difference between the slot and wire diameter for a blade arranged at 45° to the central axis of the connector body. It will be appreciated that the contact arm displacement or lateral movement is less than the width of the slot. In the example illustrated it is two thirds of the slot width.

In the housing illustrated in FIG. 2, torsional support of the contact is also reduced by increasing the clearance between the contact material thickness and the receiving cavity 42 in the connector body 44. For a contact of thickness 0.5 mm, a cavity width of 0.6 mm is provided. For a wire of 0.4 mm diameter, no torsional support would be offered to the contact for a wire near the top of the slot, but for a wire of larger diameter a small torsional restraining force will be provided by interference between the walls of the cavity on the contact blades provided that this wire is near to the top of the slot in the contact only, as this restraint is only provided at the point of wire entry into the slot.

The lateral and torsional clearances of the contact in the cavity in the housing can be appreciated from FIG. 3 which shows, schematically, the lateral clearance δ and the torsional clearance y between the contact and the walls of the cavity.

The modified contact and housing described no longer operates purely on the split cylinder principal of bowing outwards on wire insertion. The action is a hybrid between that of the simple unsupported split beam and the bowing action of the split cylinder type contact. For a single wire inserted into the contact, which rests near to the bottom of the slot between the blades, the action is that of a simple split beam. When a second wire is inserted, it will rest near the top of the slot and the torsional support provided by the connector body will ensure satisfactory contact with the wire conductor. Thus it can be appreciated that the slot is long enough to receive at least two wires and can maintain good electrical contact with both in contrast to prior art connectors such as, for example, GB-A-1361127.

If the wire diameter is close to the slot width, the slot walls remain parallel and deformation of the annealed copper wire is sufficient to ensure continuity for both wires.

The contact and connector described have the advantage of being suitable for use with hard insulation wires. They have the further advantage that there are no residual torsional or other forces produced by the plastic connector housing if only a single wire is inserted into each contact. If present, these forces can tend to deform the connector housing over a long period. Even if two wires are inserted into a contact, the forces produced by the connector body are significantly less than in the prior art devices.

I claim:

1. An insulation displacement connector comprising a housing, a plurality of cavities, and a plurality of V-shaped contacts for receiving and establishing electrical contact with insulated wires, each contact having a first contact portion, a second contact portion and a medial portion having barbs located therebetween, said second contact portion comprising a pair of planar contact blades folded about an axis of the contact to define a longitudinal slot including a mouth portion having a decreasing width and located at a distal end of the second contact portion and uniform portion proximate the medial portion of the contact, the uniform portion of the slot having a uniform width, each second contact portion being received in a respective one of the plurality of cavities in the housing, each cavity being generally "V" shaped and characterized in that when an insulated wire is inserted into the slot each contact blade can freely deflect, within the cavity, in a direction generally perpendicular to the longitudinal axis of the contact and generally parallel to the plane of the respective blade, before abutting an endwall of the housing, an amount which is less than half the uniform width of the slot, wherein each cavity is further configured such that the blade deflection amount is no more than one-third of the uniform slot width.

2. An insulation displacement connector according to claim 1, wherein the uniform portion of the slot has a length sufficient to accommodate two insulated wires therein and maintain good electrical contact therewith.

3. An insulation displacement connector for accommodating a wire having hard insulation comprising:

a housing having contact receiving cavities;

at least one V-shaped insulating displacement contact positioned in one of said contact receiving cavities, the contact including a tail portion, a central portion having barbs, and a wire receiving portion, the wire receiving portion including a pair of spaced apart, generally planar, contact blades folded about a longitudinal axis of the contact to define a slot therebetween, the slot having a base and an open end configured to accept the wire and make electrical contact therewith, the slot having a substantially uniform width as far as the base of the slot;

one of said contact cavities being generally "V"-shaped and configured to accept the contact and allow for the insertion of the wire into the slot of the wire receiving portion, the cavity is further configured such that when the wire is inserted into the slot each contact blade freely deflects within the cavity a given distance in a direction generally perpendicular to the longitudinal axis of the contact and generally parallel to the plane of the respective blade, before abutting an endwall of the housing, the distance being generally less than one-half the slot width, wherein each cavity is further configured such that distance that each blade deflects is less than one-third the slot width.

4. An insulation displacement connector according to claim 3, wherein the base of the slot having a uniform width is of a sufficient length to accommodate two insulated wires and make good electrical contact with each therewith.

* * * * *